United States Patent [19]

Desaar

[11] Patent Number: 4,844,303

[45] Date of Patent: Jul. 4, 1989

[54] LADLES FOR CASTING METAL

[75] Inventor: René Desaar, Grâce-Hollogne, Belgium

[73] Assignee: Recherches et Developpements Desaar, Grâce-Hollogne, Belgium

[21] Appl. No.: 226,419

[22] Filed: Jul. 29, 1988

[30] Foreign Application Priority Data

Jul. 31, 1987 [BE] Belgium ..... 08700855

[51] Int. Cl.[4] ..... B22D 41/08

[52] U.S. Cl. ..... 222/592; 222/600; 266/236

[58] Field of Search ..... 222/592, 600; 266/236, 266/287

[56] References Cited

U.S. PATENT DOCUMENTS 4,091,971 5/1978 Tinnes et al. ..... 222/600

4,421,257 12/1983 Thrower ..... 222/600

FOREIGN PATENT DOCUMENTS 8600789 11/1986 Netherlands ..... 222/600

*Primary Examiner*—Robert McDowell

*Attorney, Agent, or Firm*—Kramer, Brufsky & Cifelli

[57] ABSTRACT

A ladle for casting molten metal comprising an inner nozzle forming a casting channel and a ladle closing device comprising a fixed element and a moving element, the inner nozzle being surrounded by an annular cooling chamber along part of its length. The annular chamber (3) contains an annular ring (5), the interior of which communicates with a duct (6) supplying a cooling fluid, the hollow ring (5) extending into the annular chamber so as to surround the inner nozzle (12), and the wall of the ring (5) being formed with a number of orifices (7) distributed all along the ring so as to direct jets of cooling fluid on to the fixed plate (12) of the ladle cooling device around the casting hole in the plate (22).

11 Claims, 3 Drawing Sheets

LADLES FOR CASTING METAL

The invention relates to ladles for casting molten metal, and relates more particularly to an improvement to the ladles for energetic internal cooling of the refractory elements inside the metal boxes or casings of the ladle closing device during use and maintenance thereof.

The ladle base comprises an inner nozzle forming a channel for casting liquid metal, and a closure device having an outer nozzle for preventing or releasing a flow of liquid metal from the ladle. During casting, the stream of liquid metal flows through the casting channel of the refractory-material inner nozzle and then travels through a casting hole in the refractory-material elements of the closure device.

During casting, the molten metal continuously erodes the inner-nozzle casting channel wall and, owing to the high temperature of the liquid metal, causes appreciable wear in the wall of the casting hole in the refractory elements of the closure device, inter alia in the fixed plate and the moving plate disposed between the inner and outer nozzle. As a result, the fixed refractory plate of the closure device is brought to a high temperature and impedes the sliding of the moving refractory plate on the fixed refractory plate in order to release or stop the stream of liquid metal during each casting operation. Also, the high temperature of the fixed plate results in decarbonization which adversely affects the refractory material therein.

During maintenance operations on casting ladles, when the casting channel is still filled with metal and mainly solidified slag, the plug or core of metal and slag is burnt by an oxygen lance so as to clean the inner nozzle wall. At the point of contact, the burner dart produces a very considerable increase in temperature and damages the surface of the casting channel.

It is already known for the inner nozzle of a casting ladle to be surrounded by an annular cooling chamber extending part of the way along the nozzle. This feature, however, does not ensure efficient cooling of the refractory elements of the ladle closing device.

The invention specifically aims at an improvement for continuously and efficiently cooling the aforementioned refractory elements so as to avoid the aforementioned disadvantages.

The object according to the invention is achieved by a casting ladle in which the inner nozzle is surrounded by an annular chamber over part of its length, the annular chamber containing a hollow ring, the interior of which communicates with a duct for supplying a cooling fluid, the ring extending into the annular chamber so as to surround the inner nozzle, the wall of the ring being formed with a number of orifices distributed along the ring so as to direct cooling jets straight towards the fixed plate of the ladle closing device around the casting hole in the aforementioned plate. Means are also provided for discharging the cooling fluid from the annular chamber to the external atmosphere.

As a result of the invention, the refractory elements of the closure device have a much longer life than the closure devices in known ladles.

The invention will now be explained with reference to the accompanying drawings in which.

Figure 1:
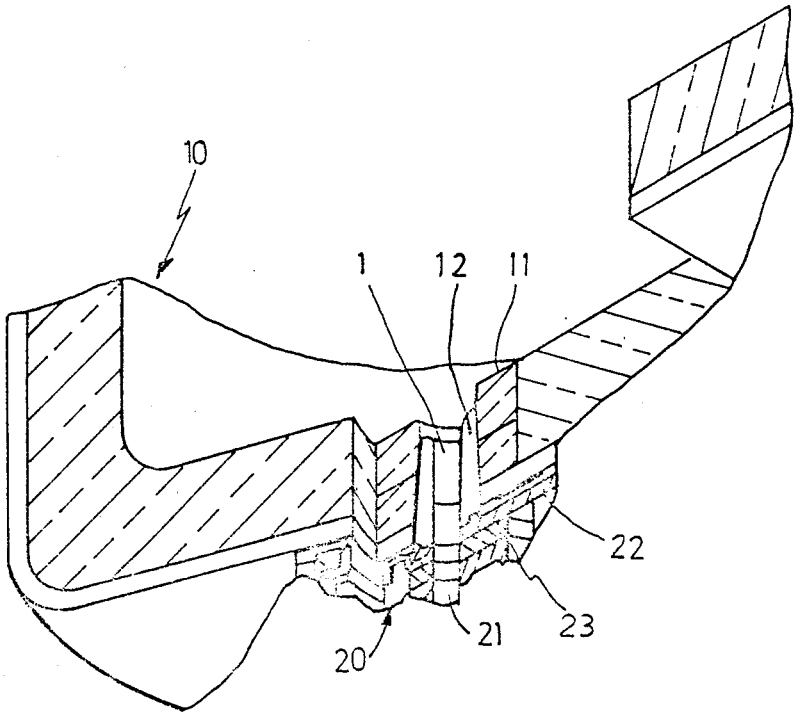
FIG. 1 is a partial perspective view of the base of a casting ladle.

FIG. 1 shows the base of a casting ladle 10 comprising an inner nozzle 12 forming a casting channel 1 and a ladle closing device 20 having a collecting or external nozzle 21 disposed coaxially with the casting channel 1. The inner nozzle 12, made of refractory material, is disposed in an opening formed in a refractory-material seating brick 11 which lines the base of the ladle. The closure device 20 comprises a fixed element 22 secured to the base of the ladle and a moving element 23 actuated by a drive device (not shown) in order to move the external nozzle 21 into alignment with the casting channel so as to release a flow of liquid metal, or in order to block the casting channel. The fixed element 22 comprises a refractory plate, called the fixed plate, disposed in a metal casing and formed with a casting hole; the moving component 23 comprises a refractory plate disposed in a metal casing and formed with one or more casting holes each communicating with an outer nozzle.

Figure 2:
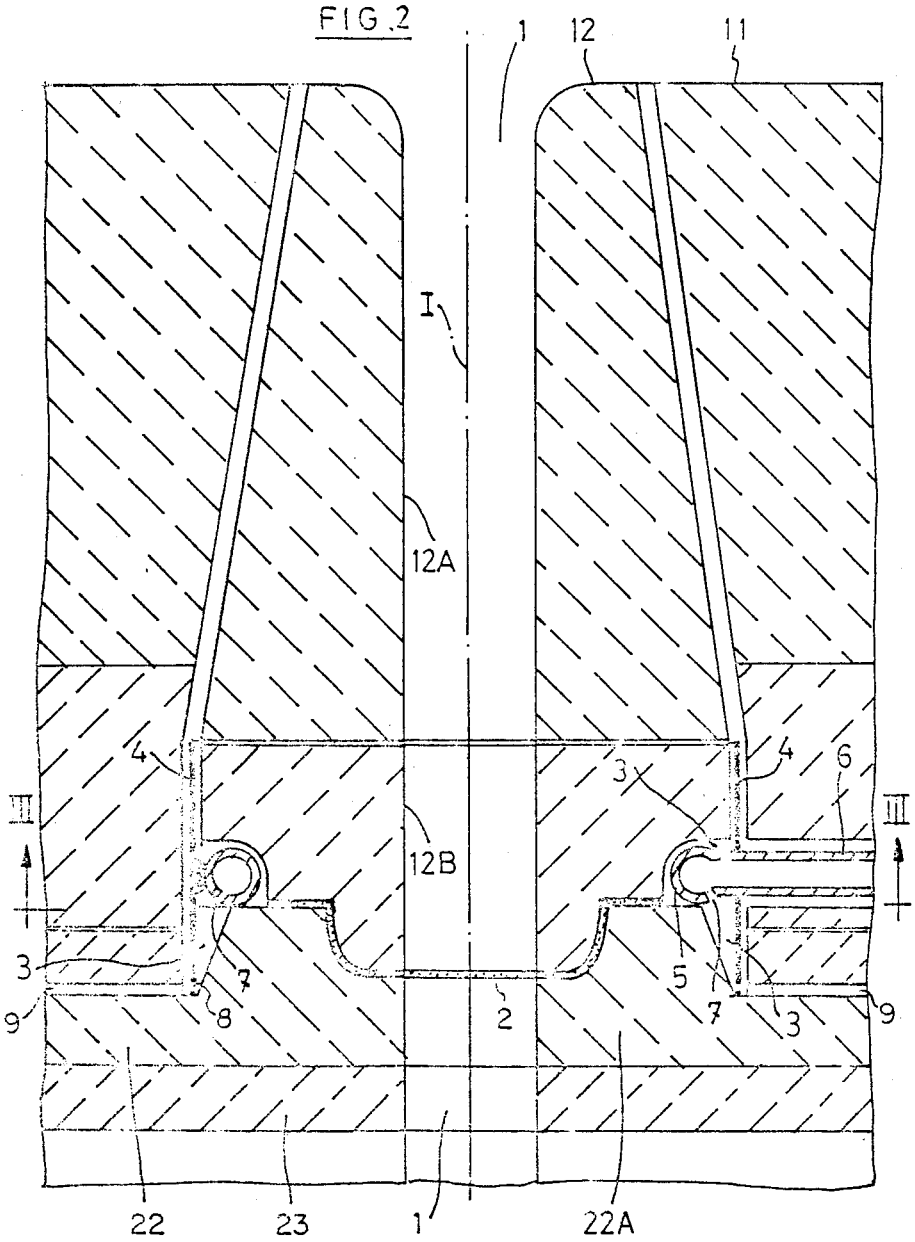
FIG. 2 shows an axial section of the casting system comprising the cooling device according to the invention.
Figure 3:
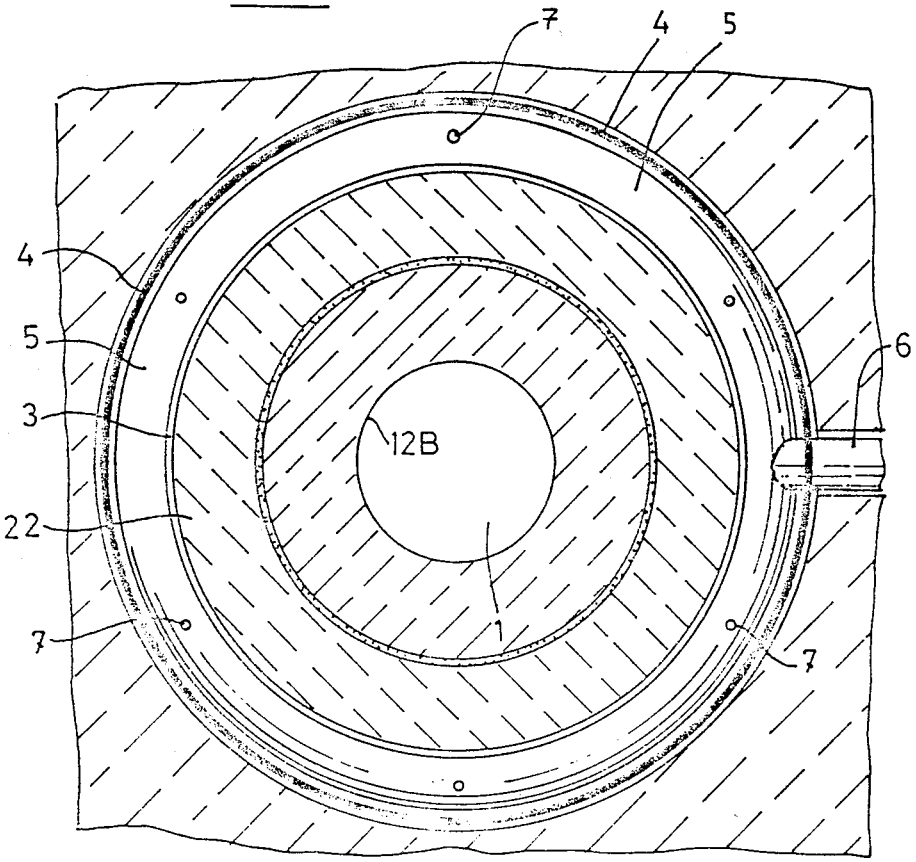
FIG. 3 is a section along line III—III of FIG. 2.

The complete casting device is shown on a larger scale in FIG. 2. In FIG. 2, the inner nozzle is in two parts: a nozzle body 12A and a wear part 12B adjacent the fixed plate 22 of the closure device and joined thereto by a bead 2. Of course, the inner nozzle 12 could be in one piece.

According to the invention, the wear part 12B of the inner nozzle 12, or the equivalent end part of a nozzle, is surrounded by an annular chamber 3 externally bounded by a metal collar 4 and containing a hollow ring 5 extending transversely to the axis I of the casting channel 1. Ring 5 is welded to the interior of collar 4 at a number of places distributed around the ring periphery, or continuously over the entire periphery of the ring. The interior of ring 5 communicates with a duct 6 for supplying a cooling fluid, and the wall of ring 5 is formed with a number of orifices 7 distributed along the entire ring so as to direct jets of cooling fluid towards the base of the cooling chamber and consequently towards the fixed plate 22 all around the cooling hole therein.

In the embodiment shown by way of example in FIG. 2, the wear part 12B of the inner nozzle 12 is formed with a peripheral recess for receiving the casting ring 5, and the fixed plate 22 is given a cross-section such that its part 22A situated around the casting hole is partly surrounded by the bottom part of the annular chamber 3 which receives the cooling jets distributed by ring 5, thus further improving the efficiency of cooling the fixed plate 22. The cooling fluid is discharged through channels 9 extending radially along the surface of the fixed plate 22 between the bottom part of the annular chamber 3 and the external atmosphere, via orifices 8 formed near the bottom edge of collar 4.

Accordingly, when a cooling fluid is distributed in the annular chamber 3 around the bottom part of nozzle 12, the jets of cooling fluid directed straight towards the fixed plate 22 energetically and uniformly cool it and prevent the refractory wall of the casting hole therein from wearing away too quickly. The cooling fluid is preferably an inert gas such as argon or dried air, to prevent decarbonization of the refractory material forming the fixed plate. Tests have shown that, owing to the cooling device according to the invention, the number of casting operations which can be carried out without replacing the refractory elements in the casting system is double the number of casting operations which can be performed with prior art ladles.

I claim:

1. A ladle for casting molten metal comprising an inner nozzle (12) forming a casting channel and a ladle closing device comprising a fixed plate (22) and a moving plate (23), the inner nozzle being surrounded by an annular cooling chamber (3) along part of its length, wherein the annular chamber (3) contains an annular ring (5), the interior of which communicates with a duct (6) supplying a cooling fluid, the hollow ring (5) extending into the annular chamber so as to surround the inner nozzle (12), and the wall of the ring (5) being formed with a number of orifices (7) distributed all along the ring so as to direct jets of cooling fluid on to the fixed plate (22) of the ladle cooling device around the casting hole in the plate (22).

2. A ladle according to claim 1, further comprising means whereby the cooling fluid distributed in the annular chamber (3) is discharged to the external atmosphere, the means comprising channels (9) extending radially along the surface of the fixed plate (22) from the periphery of the annular chamber (3).

3. A ladle according to claim 2, wherein the annular chamber (3) is externally bounded by a metal collar (4).

4. A ladle according to claim 2, wherein the part of the fixed plate (22) surrounding the casting hole is given a cross-section so as to be partly surrounded by the bottom part of the annular chamber (3).

5. A ladle according to claim 2, wherein the end of the inner nozzle (12) adjacent the fixed plate (22) of the closure device is formed with a peripheral recess for receiving the hollow ring (5).

6. A ladle according to claim 1, wherein the annular chamber (3) is externally bounded by a metal collar (4).

7. A ladle according to claim 6, wherein the part of the fixed plate (22) surrounding the casting hole is given a cross-section so as to be partly surrounded by the bottom part of the annular chamber (3).

8. A ladle according to claim 6, wherein the end of the inner nozzle (12) adjacent the fixed plate (22) of the closure device is formed with a peripheral recess for receiving the hollow ring (5).

9. A ladle according to claim 1, wherein the part of the fixed plate (22) surrounding the casting hole is given a cross-section so as to be partly surrounded by the bottom part of the annular chamber (3).

10. A ladle according to claim 9, wherein the end of the inner nozzle (12) adjacent the fixed plate (22) of the closure device is formed with a peripheral recess for receiving the hollow ring (5).

11. A ladle according to claim 1, wherein the end of the inner nozzle (12) adjacent the fixed plate (22) of the closure device is formed with a peripheral recess for receiving the hollow ring (5).

* * * * *